US007786456B2

(12) United States Patent
Singh et al.

(10) Patent No.: US 7,786,456 B2
(45) Date of Patent: Aug. 31, 2010

(54) APPARATUS FOR PROVIDING ADDITIONAL RADIATION SHIELDING TO A CONTAINER HOLDING RADIOACTIVE MATERIALS, AND METHOD OF USING THE SAME TO HANDLE AND/OR PROCESS RADIOACTIVE MATERIALS

(75) Inventors: Krishna P. Singh, Jupiter, FL (US); Stephen Agace, Marlton, NJ (US)

(73) Assignee: Holtec International, Inc.

( * ) Notice: Subject to any disclaimer, the term of this patent is extended or adjusted under 35 U.S.C. 154(b) by 383 days.

(21) Appl. No.: 11/871,095

(22) Filed: Oct. 11, 2007

(65) Prior Publication Data

US 2008/0265182 A1 Oct. 30, 2008

Related U.S. Application Data

(60) Provisional application No. 60/850,733, filed on Oct. 11, 2006.

(51) Int. Cl.

| | |
|---|---|
| ***G21C 19/06*** | (2006.01) |
| ***G21C 19/32*** | (2006.01) |
| ***G21F 5/00*** | (2006.01) |

(52) U.S. Cl. ..... 250/507.1; 250/506.1; 250/515.1; 376/272; 588/16

(58) Field of Classification Search ..... 250/506.1, 250/507.1, 515.1; 376/272; 588/16
See application file for complete search history.

(56) References Cited

U.S. PATENT DOCUMENTS

| | | | | |
|---|---|---|---|---|
| 4,527,066 | A * | 7/1985 | Dyck et al. | 250/507.1 |
| 6,064,710 | A * | 5/2000 | Singh | 376/272 |
| 6,718,000 | B2 * | 4/2004 | Singh et al. | 376/272 |

* cited by examiner

*Primary Examiner*—Jack I Berman
(74) *Attorney, Agent, or Firm*—The Belles Group, PC

(57) ABSTRACT

A system, method and apparatus for providing additional radiation shielding to a container holding radioactive materials. The invention utilizes a sleeve-like structure that is slid over a container holding high level radioactive materials to add radiation shielding protection. Because the sleeve-like structure and container are non-unitary and slidably separable from one another, crane lifting capacity is not affected. In one aspect, the invention is an apparatus comprising: a tubular shell constructed of a gamma radiation absorbing material and having an inner surface that forms a cavity having an axis, the cavity having an open top end and an open bottom end; a plurality of spacers extending from the inner surface of the shell toward the axis of the cavity, the spacers extending a first height from the inner surface of the tubular shell; and one or more flange members located at or near the open top end of the cavity extending from the tubular shell toward the axis of the cavity, the flange member extending a second height from the inner surface of the shell, the second height being greater than the first height.

20 Claims, 9 Drawing Sheets

APPARATUS FOR PROVIDING ADDITIONAL RADIATION SHIELDING TO A CONTAINER HOLDING RADIOACTIVE MATERIALS, AND METHOD OF USING THE SAME TO HANDLE AND/OR PROCESS RADIOACTIVE MATERIALS

CROSS-REFERENCE TO RELATED APPLICATION

The present application claims the benefit of U.S. Provisional Application No. 60/850,733, filed on Oct. 11, 2006, the entirety of which is hereby incorporated by reference.

FIELD OF INVENTION

The present invention relates generally to the field of transporting and/or preparing high level radioactive waste ("HLW") for dry storage, and specifically to apparatus and methods for transporting, removing and/or preparing HLW for dry storage from a fuel pool/pond.

BACKGROUND OF THE INVENTION

In the operation of nuclear reactors, the nuclear energy source is in the form of hollow zircaloy tubes filled with enriched uranium, typically referred to as fuel assemblies. When the energy in the fuel assembly has been depleted to a certain level, the assembly is removed from the nuclear reactor. At this time, fuel assemblies, also known as spent nuclear fuel, emit both considerable heat and extremely dangerous neutron and gamma photons (i.e., neutron and gamma radiation). Thus, great caution must be taken when the fuel assemblies are handled, transported, packaged and stored.

After the depleted fuel assemblies are removed from the reactor, they are placed in a canister. Because water is an excellent radiation absorber, the canisters are typically submerged under water in a pool. The pool water also serves to cool the spent fuel assemblies. When fully loaded with spent nuclear fuel, a canister weighs approximately 45 tons. The canisters must then be removed from the pool because it is ideal to store spent nuclear fuel in a dry state. The canister alone, however, is not sufficient to provide adequate gamma or neutron radiation shielding. Therefore, apparatus that provide additional radiation shielding are required during transport, preparation and subsequent dry storage.

The additional shielding is achieved by placing the canisters within large cylindrical containers called casks. Casks are typically designed to shield the environment from the dangerous radiation in two ways. First, shielding of gamma radiation requires large amounts of mass. Gamma rays are best absorbed by materials with a high atomic number and a high density, such as concrete, lead, and steel. The greater the density and thickness of the blocking material, the better the absorption/shielding of the gamma radiation. Second, shielding of neutron radiation requires a large mass of hydrogen-rich material. One such material is water, which can be further combined with boron for a more efficient absorption of neutron radiation.

There are generally two types of casks, transfer casks and storage casks. Transfer casks are used to transport spent nuclear fuel within the nuclear facility. Storage casks are used for the long term dry state storage. Guided by the shielding principles discussed above, storage casks are designed to be large, heavy structures made of steel, lead, concrete and an environmentally suitable hydrogenous material. However, because storage casks are not typically moved, the primary focus in designing a storage cask is to provide adequate radiation shielding for the long-term storage of spent nuclear fuel. Size and weight are at best secondary considerations. As a result, the weight and size of storage casks often cause problems associated with lifting and handling. Typically, storage casks weigh approximately 150 tons and have a height greater than 15 ft. A common problem is that storage casks cannot be lifted by the cranes in typical nuclear power plants because their weight exceeds the rated capacity of the crane. Another common problem is that storage casks are too large to be placed in storage pools. Thus, in order to store spent nuclear fuel in a storage cask, a loaded canister must be removed from the storage pool, prepared in a decontamination station, and transported to the storage cask. Additional radiation shielding is required throughout all stages of the transport and preparation procedures.

Removal from the storage pool and transport of the loaded canister to the storage cask is facilitated by a transfer cask. Generally, an empty canister is first placed within an open transfer cask. The transfer cask and empty canister are then submerged in the storage pool. After the fuel assemblies are removed from the nuclear reactor they are placed into the pool, within the submerged canister. While underwater, the loaded canister is fitted with a lid, thereby enclosing water and the fuel assemblies within the canister. The transfer cask, which contains the loaded canister, is then removed from the pool by a crane, or other similar piece of equipment. After being removed from the pool, the transfer cask is placed on a decontamination station to prepare the spent nuclear fuel for long-term storage in the dry state. In the decontamination station the bulk water is pumped out of the canister, thereby reducing the combined weight of the canister and transfer cask. This is called dewatering. Once dewatered, the spent nuclear fuel is further dried to an acceptable level through an appropriate drying method. Once adequately dry, the canister is back-filled with an inert gas, such as helium. The canister is then sealed and a radiation absorbing lid is secured to the transfer cask body. The transfer cask and canister are then transported to the storage cask where the canister will be transferred to the storage cask. In some instances, the transfer cask itself may be used as the storage cask.

Transfer casks are designed to be lighter and smaller than storage casks because a transfer cask must be lifted and handled by the plant's crane. A transfer cask must be small enough to fit in a storage pool and light enough so that when it is loaded with a canister of spent nuclear fuel, its weight does not exceed the crane's rated weight limit. Importantly, however, a transfer cask must also perform the vital function of providing adequate radiation shielding for both neutron and gamma radiation emitted by the enclosed spent nuclear fuel. The transfer cask must also be designed to provide adequate heat transfer. Thus, in designing transfer casks and their handling procedures, the desirability of maximizing radiation shielding (which is generally achieved by increasing the mass of the cask's structure) must be balanced against the competing interest of keeping the combined weight of the transfer cask and its payload within the crane's rated weight limit.

In order to achieve the necessary gamma and neutron radiation shielding properties, transfer casks are typically constructed of a combination of a gamma absorbing material (e.g., lead, steel, concrete, etc.) and a neutron absorbing material (e.g., water or another material that is rich in hydrogen). The body and lid of the cask, which are generally formed of lead, steel, concrete or a combination thereof, form the cavity in which the spent fuel is to be positioned and function as a containment boundary for all radioactive particulate matter.

While the pool water sealed within the canister provides some neutron shielding, this water is eventually drained at the decontamination staging area. Therefore, many transfer casks have either a separate layer of neutron absorbing material or have an annular space filled with water that circumferentially surrounds the cavity of the transfer cask and/or the containment boundary formed by the body. Such annular spaces are typically referred to as water jackets.

As stated previously, greater radiation shielding is provided by increased thickness and density of the gamma and neutron absorbing materials. However, increasing the thickness and density of the materials used to make the transfer cask results in a heavier transfer cask. Thus, the extent of radiation shielding is directly proportional to the weight of the transfer cask. The weight of a transfer cask, however, must remain below the rated lifting capacity of the crane. The load handled by the crane includes the weight of the transfer cask and the combined weight of the canister and the fuel assemblies and water (i.e. the transfer cask's payload). A transfer cask must be designed so that the total load does not exceed the rated limit of the crane. Thus, the permissible weight of the transfer cask is the rated lifting capacity of the crane minus the weight of its payload. It is important to note that when the combined weight of the transfer cask and its payload is equal to the rated lifting capacity of the crane, the radiation shielding provided by the transfer cask is at a maximum for that particular payload. This is so because the thickness of the gamma and neutron absorbing materials are at a maximum for that crane and that payload.

The weight of the transfer cask's payload varies during the different stages of the transport procedure. The permissible weight of the transfer casks is calculated when the payload is at its maximum. This occurs when the transfer cask is being lifted out of the pool because it contains a loaded canister which is full of about 70 tons of water and the nuclear fuel assemblies. Upon dewatering in the decontamination station, the weight of the transfer cask drops below the rated capacity of the crane and typically remains so throughout the remaining procedures. As such, the radiation shielding provided by the transfer cask is sub-standard throughout the procedure following removal from the storage pool. However, a heavier transfer cask cannot be used throughout the entirety of the transport procedure because the combined weight of the heavier transfer cask and its payload would exceed the rated lifting capacity of the crane during the initial step of lifting the transfer cask from the storage pool. Thus, the maximum amount of radiation shielding is not provided throughout every step of the transfer and dry-storage preparation procedure.

While it is possible to transfer the canister of spent nuclear fuel to a heavier transfer cask once the payload is lightened from dewatering, this would take additional time, money, effort, space and equipment. An additional transfer would also increase the amount of radiation exposure to personnel and the risk of a handling accident. A need exists for an apparatus that can provide the maximum amount of shielding throughout all stages of transferring spent nuclear fuel. A need also exists for a method of transferring a canister of spent nuclear fuel from a storage pool that provides the maximum amount of radiation shielding during all stages of the transfer procedure, even when the weight of the transfer cask's load varies.

SUMMARY OF THE INVENTION

It is an object of the present invention to provide an apparatus that can provide the maximum amount of radiation shielding during all stages of an HLW transfer procedure.

Another object of the present invention is to provide an apparatus for transferring HLW, the weight of which can be easily and quickly varied to maximize the amount of radiation shielding for a varied payload without substantially increasing the transfer procedure cycle time.

Yet another object of the present invention is to provide an apparatus for maximizing radiation shielding that can be placed around the transfer cask safely and efficiently subsequent to removal from the storage pool.

Still another object of the present invention is to provide a method of transferring HLW that provides the maximum amount of radiation shielding during all stages of the transfer procedure, even when the weight of the payload is varied.

Yet another object of the present invention is to provide a method of transferring HLW that provides adequate radiation shielding during all stages of the process even when a low capacity crane is utilized.

Still another object of the present invention is to provide a method of transferring HLW that minimizes the weight of the apparatus' payload at the initial step of lifting the apparatus out of a storage pool.

It is a further object of the present invention to provide an apparatus that can provide a natural thermosiphon circulation of a neutron absorbing fluid within a jacket for facilitating increased cooling of HLW.

A still further object of the present invention is to provide a method of transferring HLW from a submerged state in a fuel pool to a staging area that utilizes the buoyancy of the water in the pool.

These and other objects are met by the present invention, which is one aspect can be an apparatus for transporting and/or storing radioactive materials comprising: a gamma radiation absorbing body forming a cavity for receiving radioactive material; a jacket surrounding the body thereby forming a gap between the body and the jacket for holding a neutron absorbing fluid; a baffle positioned in the gap in spaced relation to both the body and the jacket so as to divide the gap into an inner region and an outer region; a passageway at or near a bottom of the gap between the inner region and the outer region that allows the neutron absorbing fluid to flow from the outer region into the inner region; and a passageway at or near a top of the gap between the inner region and the outer region that allows the neutron absorbing fluid to flow from the inner region into the outer region In another embodiment, the invention can be a jacket apparatus for providing neutron radiation shielding to a container holding radioactive materials comprising: an enclosed volume formed by a plurality of surfaces comprising an inner wall and an outer wall; a baffle positioned in the enclosed volume in spaced relation to the inner and outer walls so as to divide the enclosed volume into an inner region and an outer region; at least one passageway at or near a top end of the enclosed volume spatially connecting the inner region and the outer region; and at least one passageway at or near a bottom end of the enclosed volume spatially connecting the inner region and the outer region.

In another embodiment, the invention can be a method for transporting and/or storing radioactive materials comprising: providing a container having a cavity, a water jacket surrounding the cavity and forming an annular gap filled with a neutron absorbing fluid, a baffle positioned in the annular gap so as to divide the annular gap into an inner region and an outer region, a lower passageway between the inner region and the outer region, and an upper passageway between the inner region and the outer region; positioning radioactive material having a residual heat load in the cavity; and wherein heat emanating from the radioactive materials warms the neutron absorbing fluid in the inner region so as to cause the neutron absorbing fluid to flow upward in the inner region, the warmed neutron absorbing fluid flowing through the upper passageway and into the outer region where it is cooled, the cooled neutron absorbing fluid flowing downward in the outer region and back into the inner region via the lower passageway, thereby achieving a thermosiphon fluid flow.

In yet another aspect, the invention can be an apparatus for providing additional radiation shielding to a container holding radioactive materials comprising: a tubular shell extending from a first end to a second end, the tubular shell constructed of a gamma radiation absorbing material and having an inner surface that forms a cavity; a first opening in the first end of the tubular shell that provides a passageway into the cavity; a second opening in the second end of the tubular shell that provides a passageway into the cavity, the second opening being larger than the first opening; and a plurality of spacers extending from the inner surface of the shell.

In still another embodiment, the invention can be an apparatus for providing additional radiation shielding to a container holding radioactive materials comprising: a tubular shell constructed of a gamma radiation absorbing material and having an inner surface that forms a cavity having an axis, the cavity having an open top end and an open bottom end; a plurality of spacers extending from the inner surface of the shell toward the axis of the cavity, the spacers extending a first height from the inner surface of the tubular shell; and one or more flange members located at or near the open top end of the cavity extending from the tubular shell toward the axis of the cavity, the flange member extending a second height from the inner surface of the shell, the second height being greater than the first height.

In a further aspect, the invention can be a system for handling and/or processing radioactive materials comprising: a container having a first cavity for holding radioactive materials, the container having an outer surface and a top surface; a tubular shell having an inner surface that forms a second cavity for receiving the container, the tubular shell comprising at least one spacer extending from the inner surface of the shell toward an axis of the second cavity; the container positioned in the second cavity of the tubular shell, the at least one spacer maintaining the inside surface of the tubular shell in a spaced relationship from the outer surface of the container; and wherein the tubular structure is non-unitary and slidably removable from the container.

In a yet further aspect, the invention can be a method of handling and/or processing radioactive materials comprising: a) placing a container having a first cavity containing radioactive materials in a staging area, the container having an outer surface and a top surface; b) providing a tubular shell having an inner surface that forms a second cavity for receiving the container, the second cavity having an open top end and an open bottom end, the tubular shell also comprising at least one spacer extending from the inner surface of the shell toward an axis of the second cavity; and c) positioning the tubular sleeve above the container and lowering the tubular shell so that the container slidably inserts through the open bottom end and into the second cavity, the at least one spacer maintaining the inside surface of the tubular shell in a spaced relationship from the outer surface of the container so as to form a gap between the container and the tubular shell.

In still another aspect, the invention is a method of processing and/or removing radioactive materials from an underwater environment comprising: a) submerging a container having a top, a bottom, and a cavity in a body of water having a surface level, the cavity filling with water; b) positioning radioactive material within the cavity of the submerged container; c) raising the submerged container until the top of the containment apparatus is above the surface level of the body of water while a major portion of the container remains below the surface level of the body of water; and d) removing bulk water from the cavity while the top of the container remains above the surface level of the body of water and a portion of the container remains submerged.

In an even further aspect, the invention can be a method of processing and/or removing high level radioactive materials from an underwater environment comprising: a) providing a container having a cavity having an open top end and closed bottom end, the container having a top; b) positioning a canister having an open top end and a closed bottom end in the cavity of the container to form a container assembly; c) submerging the container assembly in a body of water; d) positioning high level radioactive material in the canister; e) placing a lid atop the canister that substantially encloses the top end of the canister, the lid having one or more holes; f) raising the submerged container assembly until the top of the container is above a surface level of the body of water while a major portion of the container remains below the surface level of the body of water; and g) removing bulk water from the canister while the top of the container remains above the surface level of the body of water and a portion of the container remains submerged.

In another aspect, the invention can be a method of removing spent nuclear fuel from an underwater environment and preparing the spent nuclear fuel for dry storage, the method comprising: a) providing a cask having both gamma radiation and neutron shielding properties, the cask having a top, a bottom and a cavity having an open top end and a closed bottom end; b) positioning a canister having an open end in the cavity; c) submerging the cask and canister into an underwater environment, the canister filling with water; d) positioning spent nuclear fuel within the canister; e) placing a lid atop the open canister thereby substantially enclosing the open end of the canister; f) raising the cask and canister until the top of the cask is above a water level of the underwater environment while a major portion of the cask remains below the water level; g) removing bulk water from the canister while a portion of the cask remains below the water level; and h) raising the entire cask above the water level of the underwater environment.

DETAILED DESCRIPTION

Figure 1:
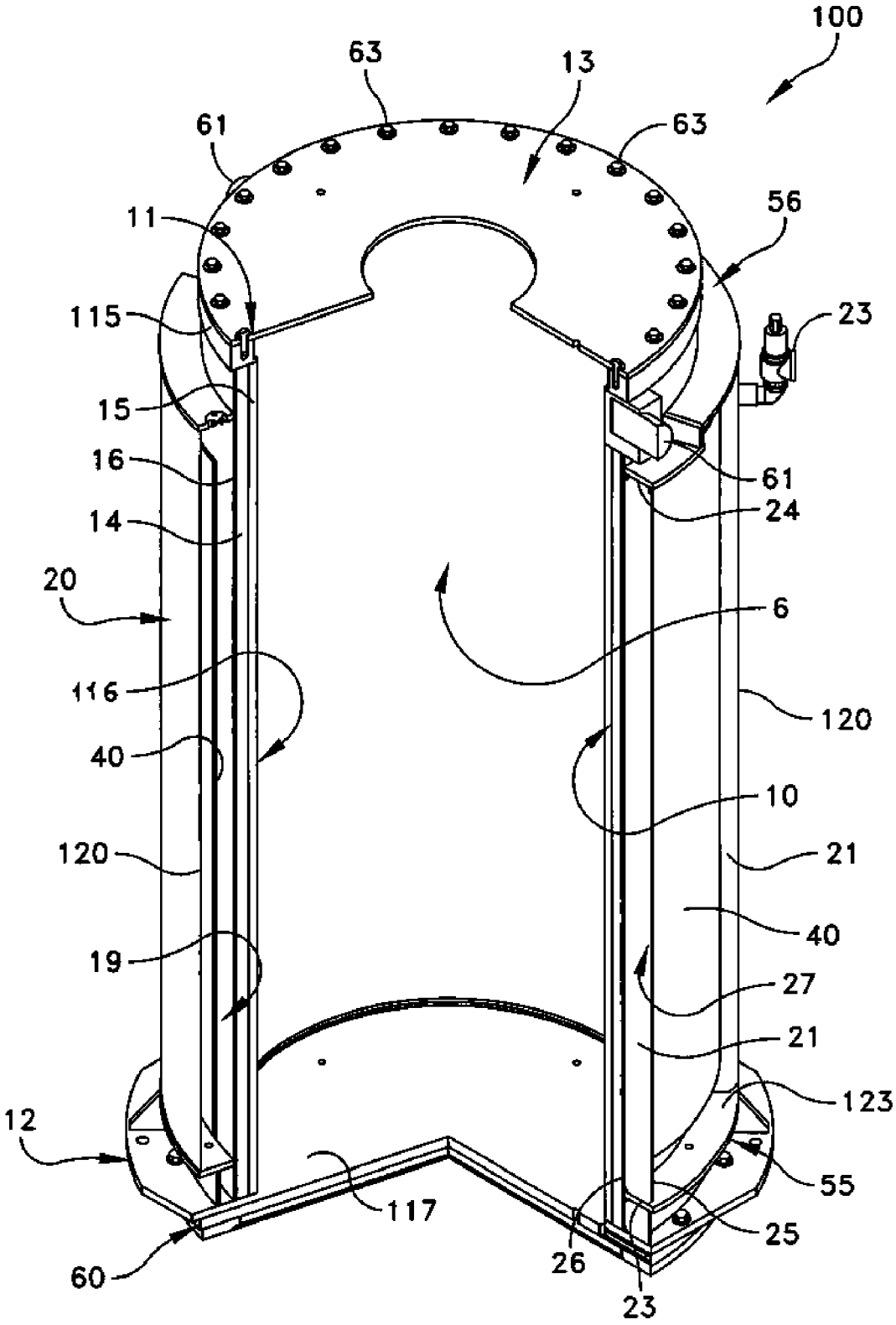
FIG. 1 is a perspective view of a transfer cask according to one embodiment of the present invention having a section cutaway.

Referring to FIG. 1, a transfer cask 100, according to one embodiment of the present invention, is illustrated. The transfer cask 100 is generally cylindrical in shape and vertically oriented such that its axis is in a substantially vertical orientation. The shape of the transfer cask 100, however, is not limiting of the invention and can include a multitude of other horizontal cross-sectional shapes, including without limitation square, rectangular, triangular and oval shaped transfer casks. The size, height and orientation of the transfer cask 100 also are not limiting of the invention but will be dictated by safety considerations, the desired load to be accommodated and the facility in which it is to be used.

The transfer cask 100, as illustrated, is designed for use with and to accommodate a multi-purpose canister ("MPC") in effectuating HLW transfer procedures. Preferably, the transfer cask 100 can accommodate no more than one canister, the invention is not so limited, however. An example of one suitable MPC is disclosed in U.S. Pat. No. 5,898,747 to Singh, issued Apr. 27, 1999. The invention, however, is not limited to the use of any specific canister structure. Furthermore, in some embodiments, the inventive concepts discussed herein can be incorporated into and/or utilized by transfer casks (or other containment structures) that do not utilize a canister. For example, the inventive concepts discussed herein can be incorporated into and/or implemented into containment structures, such as metal casks, that have the fuel basket built directly into the storage cavity.

For exemplary purposes, the transfer cask 100, and the methods discussed herein, will be described in connection with the transport, preparation and handling of spent nuclear fuel ("SNF"). However, the invention is not so limited and can be utilized to handle, transport and/or prepare any type of HLW, including without limitation burnable poison rod assemblies ("BPRA"), thimble plug devices ("TPD"), control rod assemblies ("CRA"), axial power shaping rods ("APSR"), wet annular burnable absorbers ("WABA"), rod cluster control assemblies ("RCCA"), control element assemblies ("CEA"), water displacement guide tube plugs, orifice rod assemblies, vibration suppressor inserts and any other radioactive materials.

The transfer cask 100 and its components have a top and bottom. As used herein, "bottom" refers to the end of the transfer cask 100 (or its component) that is closer to the ground than the respective end of the transfer cask 100 (or the component) that is the "top," when the transfer cask 100 is used in the contemplated vertical orientation of FIG. 1. The terms "top" and "bottom" are not so limited, however, and the transfer cask 100 is not limited to being used in the vertical orientation of FIG. 1. Thus, for example, when the transfer cask 100 is rotated by 90 degrees from the vertical orientation of FIG. 1, the terms "top" and "bottom" refer to ends that are at the same height from the ground, but at opposite ends of the structure and or its components.

The transfer cask 100 generally comprises a body 100, a bottom lid 60, a jacket 20 and a top lid 13. The body 10 forms a cavity 6 for receiving SNF. The body 10 functions as a gamma radiation absorbing structure for an SNF load that is located within the cavity 6. The jacket 20 functions to absorb the neutron radiation emanating from the SNF load located within the cavity 6. The jacket 20 circumferentially surrounds a major portion of the height of the body 10 and is adapted to receive a neutron absorbing fluid, such as water, boronated water, or another fluid that is rich in hydrogen. Both the body 10 and the jacket 20 draw the residual heat from the SNF load away from the cavity 6, and eventually removed from the transfer cask 100 via convective cooling forces on the outer surface of the transfer cask 100. As will be described in greater detail below with respect to FIGS. 3 and 4, the jacket 20 is designed to maximize heat removal from the SNF by creating a natural thermosiphon circulation of the neutron absorbing fluid within the jacket 20.

The body 10 is positioned atop bottom lid 60. The bottom lid 60 acts as the floor of the cavity 6 formed by the inner surface of the body 10. The bottom lid 60 is constructed so that it adequately serves as a floor portion of the gamma radiation containment boundary, thereby preventing the gamma radiation emanating from the SNF load within the cavity 6 from escaping downward. The bottom lid 60 comprises a plurality of plates in a stacked arrangement. The plates are preferably constructed of steel, lead or another gamma radiation absorbing material. A layer/plate of neutron absorbing material can be implemented into the bottom lid 60 if desired.

The bottom lid 60 is connected to the bottom of the body 10. More specifically, the bottom lid 60 is connected to the bottom surface of the bottom flange 12 of the body 10. The bottom lid 60 comprises a plurality of plates that are removable from the body 10 so as to allow transfer of the SNF load out of the bottom of the transfer cask 100 by lowering the SNF through the bottom of the cavity 6. The plates can be connected to the bottom flange 12 via bolts or other hardware. The bottom lid 60 is preferably non-unitary with respect to the body 10, thereby forming a base-to-body interface between the two. O-rings and/or other suitable seals can be implemented to hermetically seal the bottom lid 60 to the body 10. In alternate embodiments, the bottom lid 60 can be integrally formed as part of the body 10 and/or can take on a wide variety of structural detail. For example, the bottom lid 60 can be a thick forging or the like, eliminating the need for a plurality of plates.

The top lid 13 is preferably a non-unitary structure with respect to the body 10 so that the top lid 13 can be repetitively secured and unsecured to the body 10 without compromising the structural integrity of the transfer cask 100 and/or the containment boundary. The top lid 13 rests atop a top edge 11 of the body 10 so as to form a lid-to-body interface therebetween. The top edge 11 of the body is formed by the upper surface of an annular ring 115.

The top lid 13 is secured to the top edge 11 by extending bolts 63 through holes in the top lid 13 and threadily engaging corresponding bores in the top flange 11. The internal surfaces of the bores are preferably threaded for engagement with the bolts 63. While bolts 63 are illustrated as the connection means, other suitable hardware and connection techniques can be used, including without limitation screws, a tight fit, etc.

Figure 3:
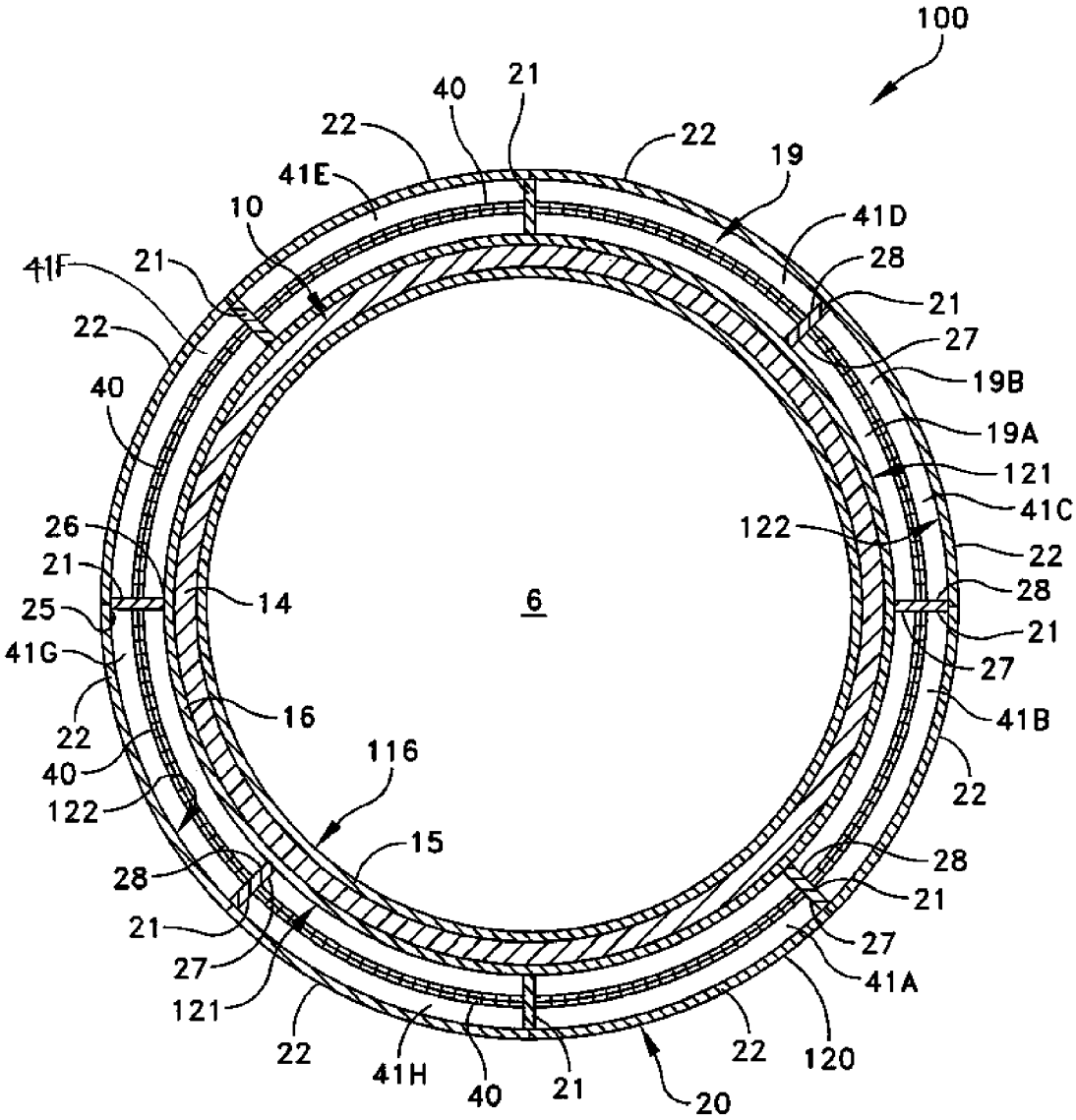
FIG. 3 is a horizontal cross-sectional view of the transfer cask of FIG. 1.

Referring now to FIGS. 1 and 3 concurrently, the body 10 comprises a first shell 15 and a second shell 16. The body 10 is constructed of gamma radiation absorbing material so as to provide the necessary containment boundary for SNF positioned in the transfer cask 100. While the shells 15, 16 are generally cylindrical in shape, other shapes can be used. For example, the horizontal cross-sectional profiles of the shells 15, 16 can be rectangular, oval, etc. The invention is not limited by the shape of the shells 15, 16. The annular ring 115 is connected to the tops of the shells 15, 16. The annular ring 115 adds structural integrity to the shells 15, 16 and provides a solid structure to which the top lid 13 can be secured.

The inner surface 116 of the first shell 15 forms a cavity 6 for receiving and holding a canister of SNF. As mentioned above, if desired, the cavity 6 can be adapted to accommodate SNF directly by incorporating a fuel basket assembly directly therein so as to eliminate the need for a canister.

The first shell 15 and the second shell 16 are preferably made from steel because of its gamma radiation absorbing and heat conducting attributes. However, other gamma absorbing materials can be used. The second shell 16 concentrically surrounds the first shell 15 so as to form an annular gap 14 therebetween which is filled with a gamma absorbing material, thereby forming an additional layer of gamma absorbing material. The annular gap 14 can be filled with any gamma absorbing material, including without limitation concrete, lead, steel, etc. or combinations thereof. Preferably, the gamma absorbing material used in the annular gap 14 is a material, such as steel, that can adequately conduct heat radially outward away from the cavity 6 so that residual heat emanating from SNF can be removed. It also possible that the annular gap 14 comprise another shell rather than a filled gap.

While the body 10 is illustrated and described as a multilayer structure, the body 10 can be constructed as a unitary structure from a single thick shell or from a combination of concrete and metal, such structural details of the body 10 are not limiting of the invention, so long as the necessary cooling and gamma radiation adsorption are provided by the body 10 for the radioactive load to be positioned in the cavity 6.

The top edges of the first and second shells 15, 16 are connected to a bottom surface of the annular ring 115 via welding or other connection technique. Similarly the bottom edges of the first and second shells 15, 16 are connected to the top surface of the bottom flange 12 of the body 10. The bottom flange 12 is a plate-like structure that contains the necessary holes and hardware for both connecting the plates of the bottom lid 16 to the body 10 and connecting the transfer cask 100 to a mating device during canister transfer operations.

Referring solely to FIG. 1, the inner surface 116 of the first shell 15 forms the cavity 6 for receiving the SNF load. The cavity 6 is a cylindrical cavity having an axis that is in a substantially vertical orientation. The invention is not so limited however, and the axis could be in a substantially horizontal orientation or another orientation. The horizontal cross-sectional profile of the cavity 6 is generally circular in shape, but is dependent on the shape of the first shell 15, which is not limited to circular. The top end of the cavity 6 is open, providing access to the cavity 6 from outside of the transfer cask 100 (the top lid 13 provides closure to the top end of the cavity 6 when secured to the transfer cask 100). The bottom end of the cavity 6 is also open, and can be closed by the bottom lid 60. More specifically, the top surface 117 of the bottom lid 60 acts as a floor for the cavity 6.

Two trunnions 61 are provided at the top of the body 10. The trunnions 61 provide a means by which a lifting device can engage the transfer cask 100 for lifting and transport. The trunnions 61 are preferably circumferentially spaced from one another about 180° apart and made of a material having high strength and high ductility. The invention is not limited to a trunnion, any means for attaching a lifting device can be used, including without limitation, eye hooks, protrusions, etc.

Referring now to FIGS. 1 and 3 concurrently, the transfer cask 100 further comprises a jacket 20. The height of jacket 20 is less than the height of body 10. The jacket 20 is preferably tall enough to cover the height of the SNF stored in the cavity 6. The jacket 20 is formed by a shell 120 which is concentric to and surrounds the second shell 16. The shell 120 can be constructed of steel or other materials, such as metals, alloys, plastics, etc. However, it is preferred that the shell 120 be formed of a good heat conducting material, such as steel. In the illustrated embodiment, the shell 120 is formed by a plurality of panels 22. A total of eight panels 22 are used to form the shell 120. The invention, however, is not so limited and the shell 120 can be a unitary shell or consist of any number of panels 22. The shell 120 has a top edge 125 and a bottom edge 126 (best seen in FIG. 4).

The jacket 20 comprises a gap/space 19 formed between the shell 120 and the second shell 16 for receiving a neutron absorbing fluid. The gap 19 is adapted to receive a neutron absorbing fluid, such as boronated water, to provide a layer of neutron shielding for the SNF load within the cavity 6. The second shell 16 acts as the inner wall of the gap 19 while the shell 120 acts as the outer wall of the gap 19.

The jacket 20 further comprises bottom ring plate 55 and a top ring plate 56 which form the floor and the roof of the gap 19. The top and bottom ring plates 55, 56 are ring-like plate structures that surround the outer surface 121 of the second shell 16. While the bottom ring plate 55 is a single unitary ring-like structure, the top ring plate 56 is formed of a plurality of sections in stepped manner to accommodate the trunnions 61. Of course, either the top or bottom ring plates 55, 56 can be constructed in either manner.

The jacket 20 further comprises one or more fill valves 23 located at or near the top of jacket 20. The fill valve 23 is adapted so as to be capable of being moved between an open position and a closed position. When the fill valve 23 is in a closed position, it is hermetically sealed. When the fill valve 23 is in the open position, it allows for efficient filling of the jacket 20 with a neutron absorbing fluid, such as boronated water or the like. The jacket 20 further comprises one or more drain valves (not illustrated). The drain valves are also adapted so as to have an open and a closed position. When the drain valves are in the open position, they allow for removal of the neutron absorbing fluid from the jacket 20. When the drain valves are in the closed position, they are hermetically sealed.

Figure 4:
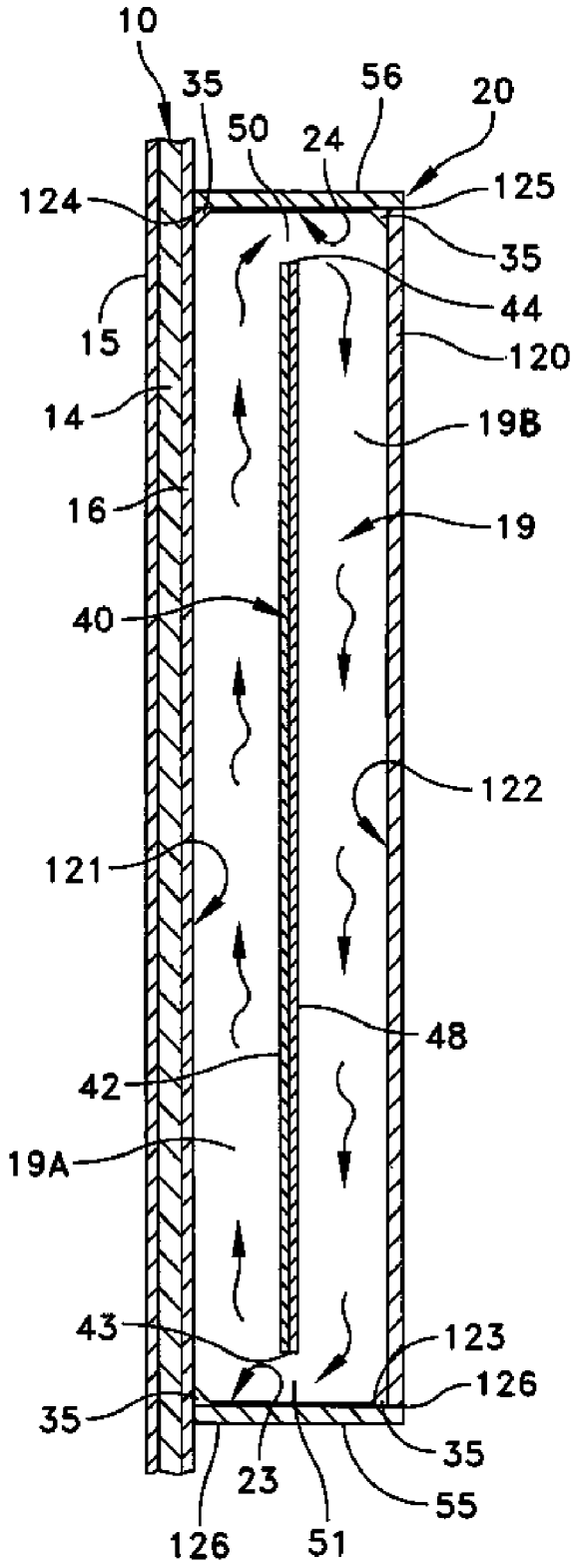
FIG. 4 is a vertical cross-sectional view of a wall of the transfer cask of FIG. 1 wherein the natural thermosiphon circulation of a neutron absorbing fluid within the jacket is illustrated according to one embodiment of the present invention.

As is best visible in FIG. 4, the bottom and top ring plates 55, 56 are respectively connected to the top and bottom edges, 125,126 of the shell 120 in a hermetic manner. Likewise, the inner edges of the bottom and top ring plates 55, 56 are connected to the outer surface 121 of the shell 16 in a hermetic manner. A proper weld will achieve these hermetic connections. The outer surface 121 of the second shell 16 acts as the inner wall of the gap 19 while the inner surface 122 of the shell 120 acts as the other wall of the gap 19. The floor of the gap 19 is formed by the top surface 123 of the bottom ring plate 55. The ceiling of the gap 19 is formed by the bottom surface 124 of the top ring plate 56. The gap 19 is a hermetically sealable space/volume capable of holding a neutron absorbing fluid without leaking. The gap 19, of course, can be other shapes beside annular.

Figure 2:
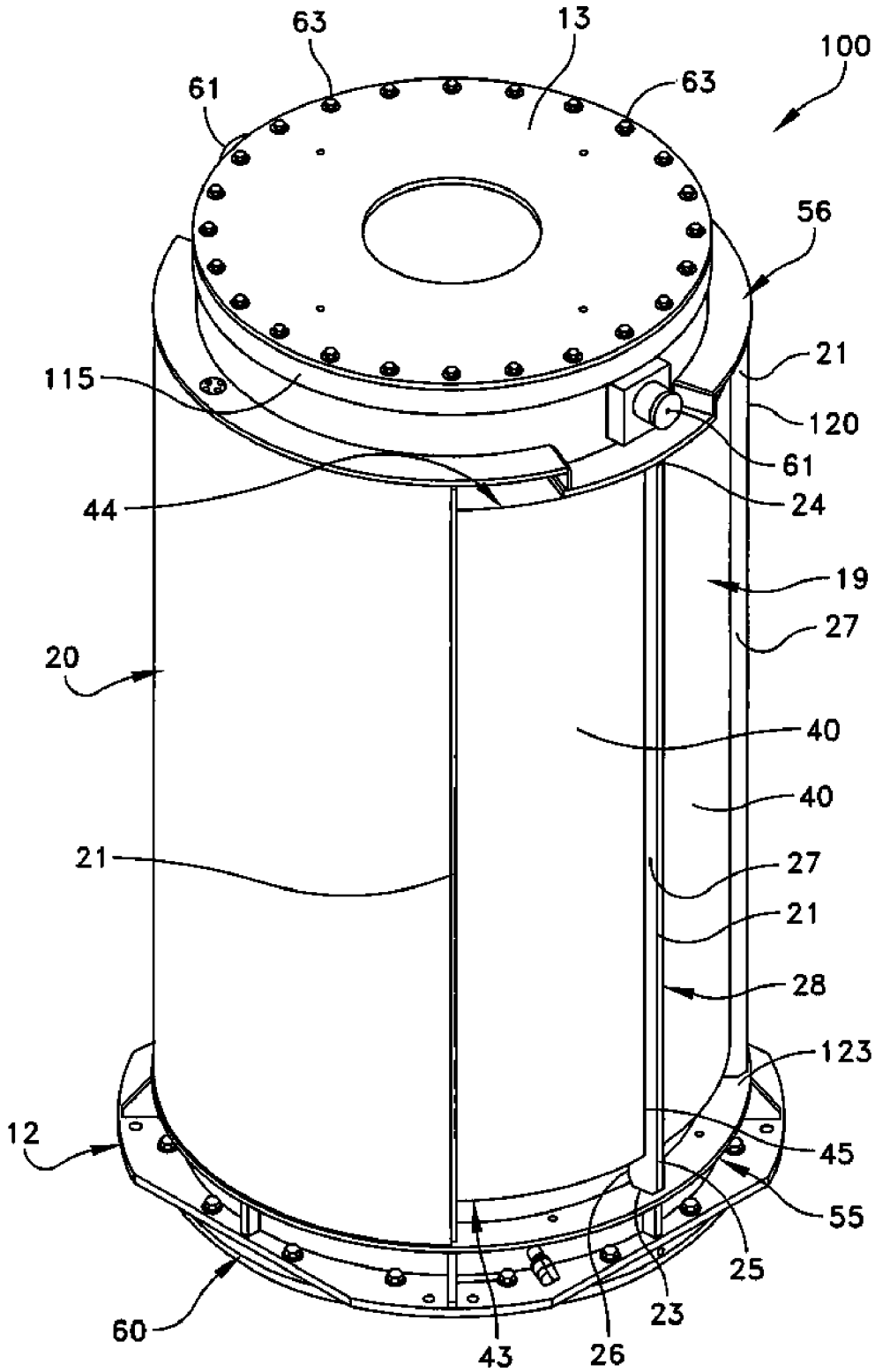
FIG. 2 is a perspective view of the transfer cask of FIG. 1 wherein two outer panels of the jacket are removed so as to expose the radial fins and baffles within the jacket.

Referring now to FIGS. 2 and 3 concurrently, the jacket 20 further comprises a plurality of radial plates 21 positioned within the gap 19. The radial plates 21 are preferably made of steel or another metal or material having good heat conduction properties. Each radial plate 21 comprises a first face 27, a second face 28, an outer lateral edge 25 an inner lateral edge 26, a top edge 24 and a bottom edge 23. The outer lateral edge 25 and inner later edge 26 are vertically oriented. The outer lateral edges 25 of the radial plates 21 are connected to the inner surface 122 of the shell 120 while the inner lateral edges 26 of the radial plates 21 are connected to outer surface 121 of the second shell 16. The radial plates 21 act as fins for improved heat conduction from the body 10, through the jacket 20 and to the atmosphere surrounding the transfer cask 100. In another embodiment, the lateral edges 25, 26 of the radial plates 21 may be radially offset from one another so that a straight line does not exist through the radial plate 21 from the second shell 16 to the jacket 20. For example, the radial plates 21 can be bent so as to have a zig-zag horizontal cross-sectional profile. This prohibits neutron radiation escape through the radial plates 21. The top edge 24 of the radial plate is connected to the bottom surface 124 of the top ring plate 56. The bottom edge 24 of the radial plate 21 is connected to the top edge 123 of the bottom ring plate 55

The radial plates 21 extend radially between the second shell 16 and the shell 120 of the jacket 20, thereby dividing the gap 19 into a plurality of circumferential zones 41A-H. At least one hole 34 (visible in FIG. 4) preferably exists that forms an open passageway between each of the adjacent circumferential zones 41A-H. By providing these holes 34, neutron absorbing fluid can flow freely throughout the entirety of the gap 19 when supplied to a single circumferential zone 41 during the jacket filling procedure. In the illustrated embodiment, the holes 34 are formed by chamfered edges of the radial plates 21. However, the passageways can be provided in any manner desired, for example as a plurality of gaps between the top edge 24 of the radial plate 21 and the top ring plate 56.

Referring still to FIGS. 2 and 3, the jacket 20 further comprises a plurality of baffles 40. As will be discussed in further detail below, the baffles 40 facilitate a natural thermosiphon circulation of the neutron absorbing fluid within the gap 19 of the water jacket 20 to assist in heat removal/cooling of the SNF within the cavity 6. The baffles 40 are plate-like structures positioned in the gap 19 in a substantially vertical orientation. The baffles 40 have a top edge 44, a bottom edge 43, a first lateral edge 45 and a second lateral edge 46 (best seen in FIG. 4). The baffles 40 are located between the shell 120 and the second shell 16 in spaced relation from both the shells 120, 16. A single baffle 40 is located within each circumferential zone 41A-41H.

The baffles 40 are supported in the gap 19 so that a distance exists between the top and bottom edges of the baffle 40 and the top and bottom ring plates 56, 55 respectively. In other words, the height of baffle 40 is less than the height of the gap 19. The baffles 40 are supported in his floating manner by connecting the lateral edges 45, 46 of the baffles 40 to the first and second faces 27, 28 of the radial plates 21. Welding or other connection techniques could be used.

Referring now to FIGS. 3 and 4 concurrently, the structure and functioning of the jacket 20 relative to the thermosiphon circulation within the gap 19 will be discussed in greater detail. The structure and functioning of the jacket 20 relative to the thermosiphon circulation will be discussed in relation to a single circumferential zone 41 with the understanding the principles and structure are applicable to all zones 41A-41H.

The baffles 40 comprise a first plate 42 and a second plate 48. The first and second plates 42, 48 are connected to one another along their major surfaces. However, as will be discussed below, this connection is preferably accomplished so that intimate surface contact does not exist between the major surfaces of inner and outer plates 42, 48 of the baffle 40. The inner and outer plates 42, 48 are preferably made of stainless steel. Moreover, while the baffles 40 are illustrated as a plurality of circumferential plates 42, 48 separated by the radial plates 21, a single plate or shell can be used to act as the baffle for the entire gap 19.

The baffle 40 is positioned in the gap 19 in radially spaced relation to the outer surface 121 of the second shell 16 and the inner surface 122 of the shell 120. Thus, the baffle 40 divides the gap 19 into an inner region 19A and an outer region 19B. The inner region 19A is that region of space located between the baffle 40 and the outer surface 121 of the second shell 16. The outer region 19B is that region of space located between the baffle 40 and the inner surface 122 of the shell 120.

As mentioned above, the height of the baffle 40 is less than the height of the gap 19. As a result, passageways 50, 51 exist between the inner region 19A and the outer region 19B. The passageway 50 is located at or near the top of the gap 19 while the passageway 51 is located at or near the bottom of gap 19. More specifically, the passageway 50 is formed between the top edge of the baffle 40 and a bottom surface 124 of the top ring plate 56. Similarly, the passageway 51 is formed between the bottom edge of the baffle 40 and a top surface 123 of the bottom ring plate 55. The invention is not so limited and passageways 50, 51, could be formed as holes in the baffle 40 itself so long as sufficient fluid passes therethrough between the inner region 19A and the outer region 19B of the gap 19. In such an embodiment, the baffle 40 could be connected to the surface 124 and the surface 123. Holes at or near the top and bottom of baffle 40 could provide the passageways for fluid to flow between the inner and outer regions 19A, 19B.

Referring solely to FIG. 4, when SNF is loaded into the cavity 6 of the transfer cask 100, the heat emanating from the SNF conducts radially outward through the body 10. As this heat exits the outer surface 121 of the second shell 16, the heat is absorbed by the neutron absorbing fluid that is located in the inner region 19A of the jacket 20. As the neutron absorbing fluid in the inner region 19A becomes heated, the warmed neutron absorbing fluid rises within the inner region 19A. As a result, cool neutron absorbing fluid from the outer region 19B is draw into the inner region 19A via the passageway 51. The heated neutron absorbing fluid that rose within the inner region 19A is likewise drawn into the outer region 19B via the passageway 50. As the heated neutron absorbing fluid comes into contact with the shell 120, the heat from the neutron absorbing fluid conducts through the shell 120 where it is removed by convective forces on the outer surface 125 of the shell 120. Thus, the neutron absorbing fluid in the outer region 19B cools.

As the neutron absorbing fluid cools in the outer region 19B, it flows downward in the outer region 19B until it is adequately cooled and drawn back into the inner region 19A where the process repeats. It is in this manner in which a natural thermosiphon circulation of the neutron absorbing fluid takes place within the gap 19 of the jacket 20. This natural fluid flow is illustrated by the wavy arrows.

In order to promote thermosiphon flow, it may be preferable that the coefficient of thermal conductivity ($K_{(B)}$) of the baffle 40 in the radial direction be less than the coefficient of thermal conductivity of the neutron absorbing fluid ($K_{(F)}$) in the gap 19. Making $K_{(B)}$ less than $K_{(F)}$ may help ensure that the neutron absorbing fluid in the outer region 19B remains cooler than the neutron absorbing fluid in the inner region 19A, thereby maximizing the fluid circulation rate. In one embodiment, this can be achieved by making the baffle 40 of two plates 42, 48 having a gap between the two. Of course, when the baffle 40 or the neutron absorbing fluid is made of a composite, then it is the effective coefficient of thermal conductivity of the baffle 40 that is preferably less than the effective coefficient of thermal conductivity of the neutron absorbing fluid.

Figure 5:
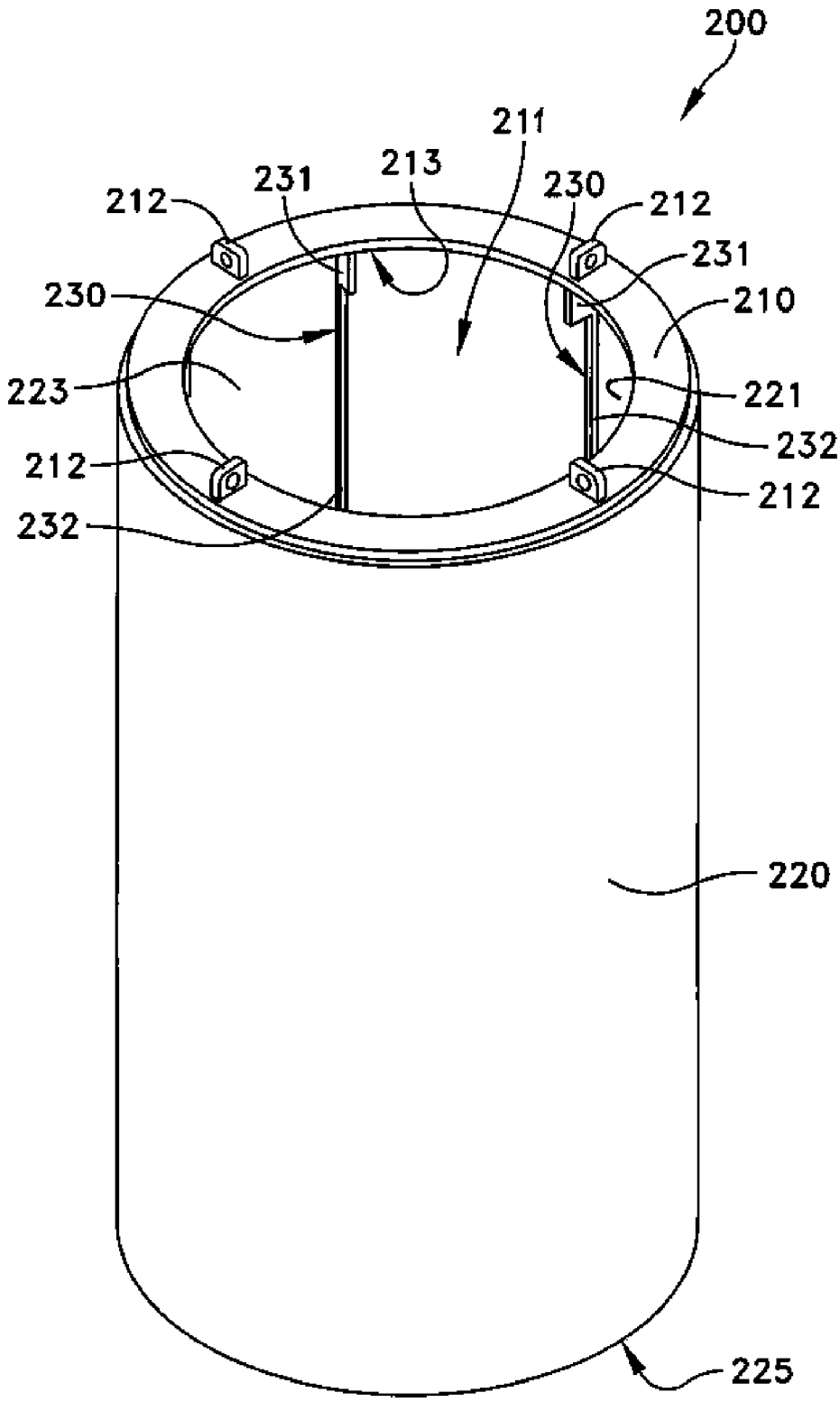
FIG. 5 is a perspective view of a removable shield for providing additional radiation shielding and projectile protection to a transfer cask according to an embodiment of the present invention.

Referring now to FIG. 5, a shield 200 according to one embodiment of the present invention is illustrated. The shield 200 is a sleeve-like structure that is designed to slidably fit over a containment apparatus, such as transfer cask 100, to provide additional radiation shielding and missile protection. The shield 200 is intended to be placed over a transfer cask once it is in the staging area (i.e. removed from the fuel pond). Although the term "staging area" generally refers to an area in a facility for drying and other preparations of a cask, as used herein, staging area can be any area of a facility including an area where nothing is being preformed to the cask. Although the shield 200 is designed for use with and to accommodate the transfer cask 100, the invention is not limited to the use of any specific transfer cask. It is to be further understood that the shield 200, in and of itself, is a novel device and can constitute an embodiment of the invention independent of the components of the transfer cask 100.

The shield 200 comprises a thick shell 220 and a top plate 210. The top plate 210 is a ring-like plate having a central opening 223. The top plate 210 is connected to the top edge of the thick shell 220. The thick shell 220 has an open bottom end thereby forming a bottom opening 225 of the shield 200. The central opening 223 has a smaller diameter than the bottom opening 225. The diameter of the bottom opening 225 is large enough so that the shield 200 can be slid over the top of the transfer cask 100, as will be discussed with reference to FIG. 6. The inner surface 221 of the shell 220 forms an internal cavity 211 for receiving the transfer cask 100. The cavity 211 has a diameter greater than the diameter of transfer cask 100, or the containment apparatus with which the shield 200 is to be used.

The shield 200 further comprises a plurality of eye hooks 212 are welded to the top surface of the top plate 210 and are used by a crane to carry the shield 200. The invention is not limited to eye hooks, any means for attaching a transport device may be used, including trunnions and other protrusions. The shell 220 and the top plate 210 are made of a gamma absorbing material, such as steel, lead, etc. The shield 200 can be as thick as required, preferably at least 5 inches thick. In another embodiment, the shield 200 could be a multi-layer structure rather that a single layer structure.

The shield 200 further comprises a plurality of spacers 230 located on the inner surface 221 of the shell 220 and the bottom surface 213 the top plate 210. The spacers 230 are generally L-shaped plates that extend radially into the cavity 211 formed by the shell 220. The spacers 230 comprises a horizontal portion 231 and a vertical portion 232. The horizontal portion 231 extends along the along the bottom surface 213 of the top plate 210 for the entire width of the top plate 210. As will be discussed below with reference to FIG. 6, the horizontal portion 231 acts as a flange to support the weight of the shield 200. In an alternative embodiment, the top plate 210 could act as a flange instead of the horizontal portion 231 of the spacers 230. In such an embodiment, the top plate 210 could extend into the cavity 211 rather than connecting solely to the top edge of the shell 230. The horizontal portion 231 extends into the cavity 211 a further distance than does the vertical portion 232. Stated another way, the horizontal portion 23 of the spacer 230 extends from the inner surface 221 of the shell 220 into the cavity 211 by a first distance. The vertical portion 232 of the spacer 230 extends from the inner surface 221 of the shell 220 into the cavity 211 by a second distance. The first distance is greater than the second distance. The vertical portion 232 extends along the inner surface 221 of the shell 220 from the horizontal portion 231 to the bottom of the shield 200. The invention is not so limited, however, and the vertical portion 232 could be segmented or formed from a plurality of pins, bars, etc. Additionally, where the vertical portion 232 is segmented, the segments do not have to be vertically aligned. The spacers 230 are preferably circumferentially spaced from another by about 60° (best seen in FIG. 7), but could comprise more spacers 230 spaced closer together, etc. The spacers 230 are made of a material having high strength and ductility, sufficient so that the horizontal portion 231 is strong enough to support the full weight of the shield 200.

Figure 6:
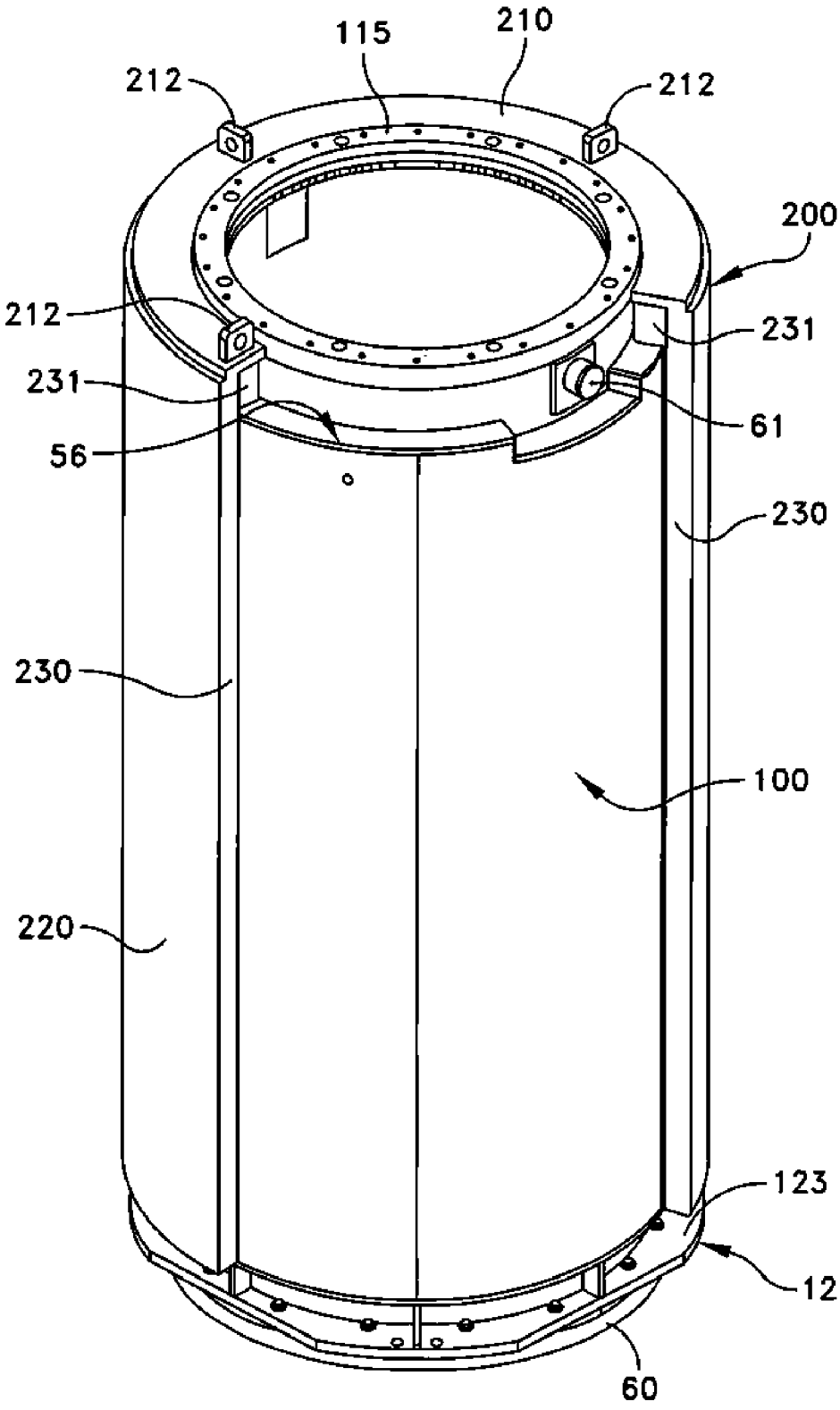
FIG. 6 is a perspective view of the shield of FIG. 5 fitted over the transfer cask of FIG. 1 according to an embodiment of the present invention wherein a section of the shield is cutaway.

Referring to FIG. 6, the shield 200 slidably fits around the transfer cask 100 so as to form a shield-to-transfer cask interface. The shield 200 has a height that is less than the height of the transfer cask 100. As a result, the shield 200 does not extend the fill height of transfer cask 100. As will be discussed below, this allows a space to exist between the shield 200 and the ground so that air can circulate under the shield 200 and over the outer surface of the transfer cask 100 when the shield 200 is fitted over the transfer cask 100. The horizontal portion 231 of the spacers 230 acts as a flange and rests on the top surface 56 of the transfer cask 100 while the vertical portion 232 of the spacers 230 contacts the outer surface of the wall of the transfer cask 100.

Figure 7:
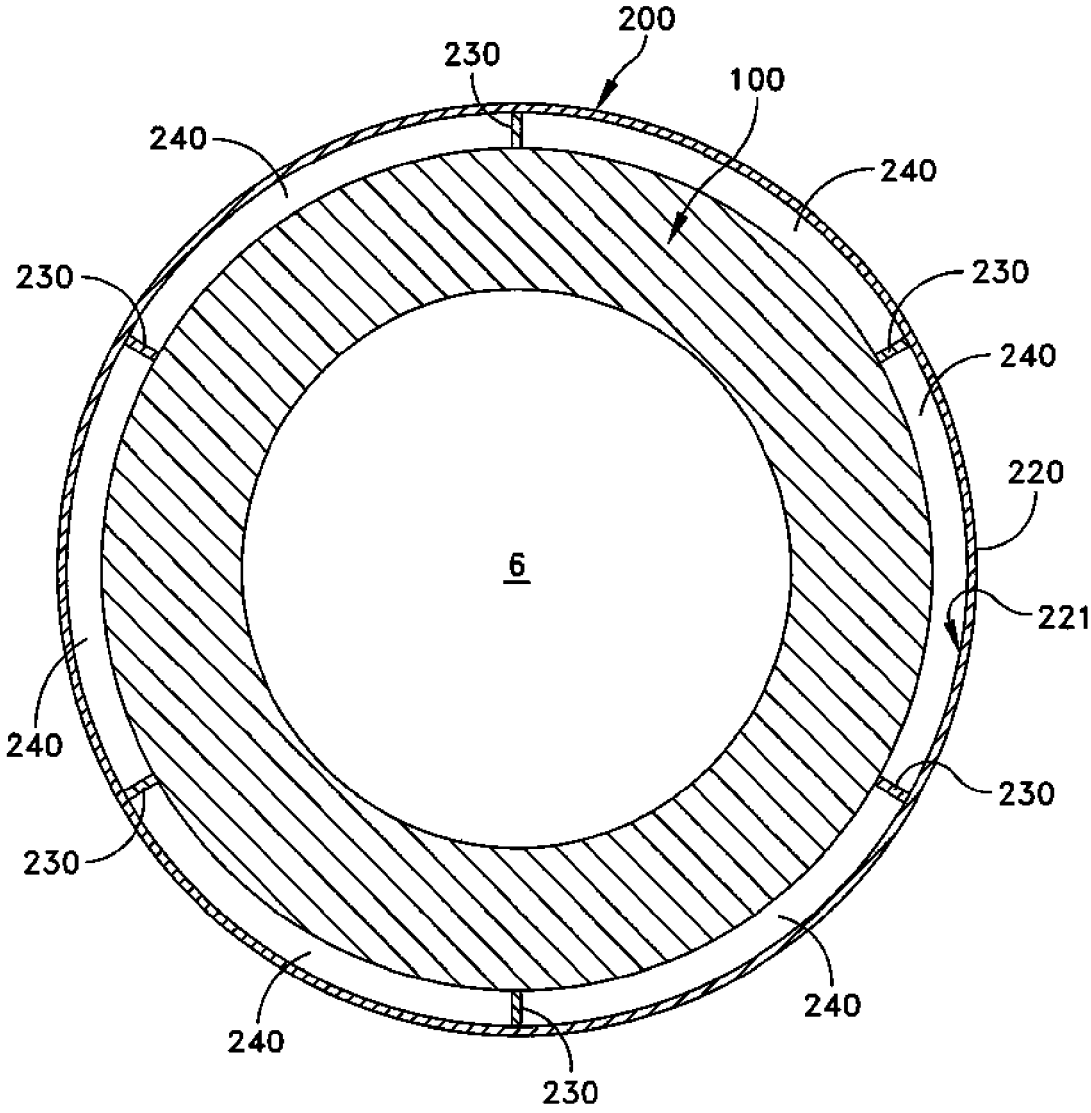
FIG. 7 is a horizontal cross-sectional view of the shield-transfer cask assembly of FIG. 6 wherein the transfer cask is schematically illustrated.

Referring to FIG. 7, the spacers 230 maintain channels 240 between the inner surface of the shell 220 spaced from the outer surface of the transfer cask 100. The spacers 230 divide the gap between the shell 220 and the cask 100 into a plurality of channels 240. The channels 240 allow air to flow between the shield 200 and the transfer cask 100 so as to cool the transfer cask 100 that is heated by the SNF stored in the cavity 6. The channels 240 are not limited to linear passageways and could be formed as tortuous paths from the bottom of the shield 200 to the top of the shield 200.

Figure 8:
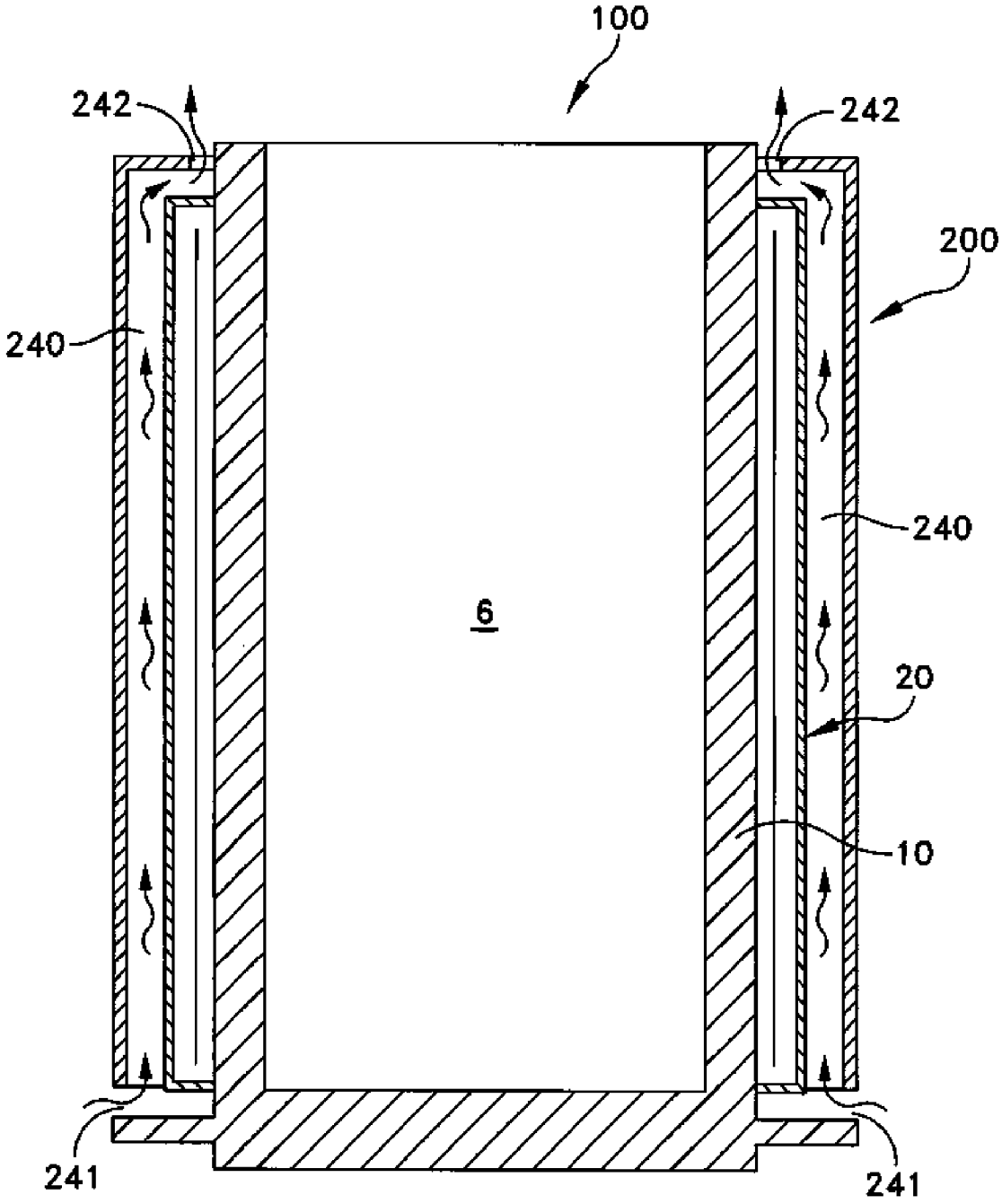
FIG. 8 is a vertical cross-sectional profile of the shield-transfer cask assembly of FIG. 6 wherein the transfer cask and natural convective flow of cooling air between the shield and the transfer cask is schematically illustrated.

Referring to FIG. 8, air can enter via an opening 241 below the shield 200 and enter into the spaces 240. The air is warmed by heat emanating from the transfer cask 100 and naturally rises within the spaces 240. The warmed air exits the spaces 240 via an exit opening 242 at the top of the shield 200. The wavy arrows indicate this natural thermosiphon/chimney flow.

Figure 9:
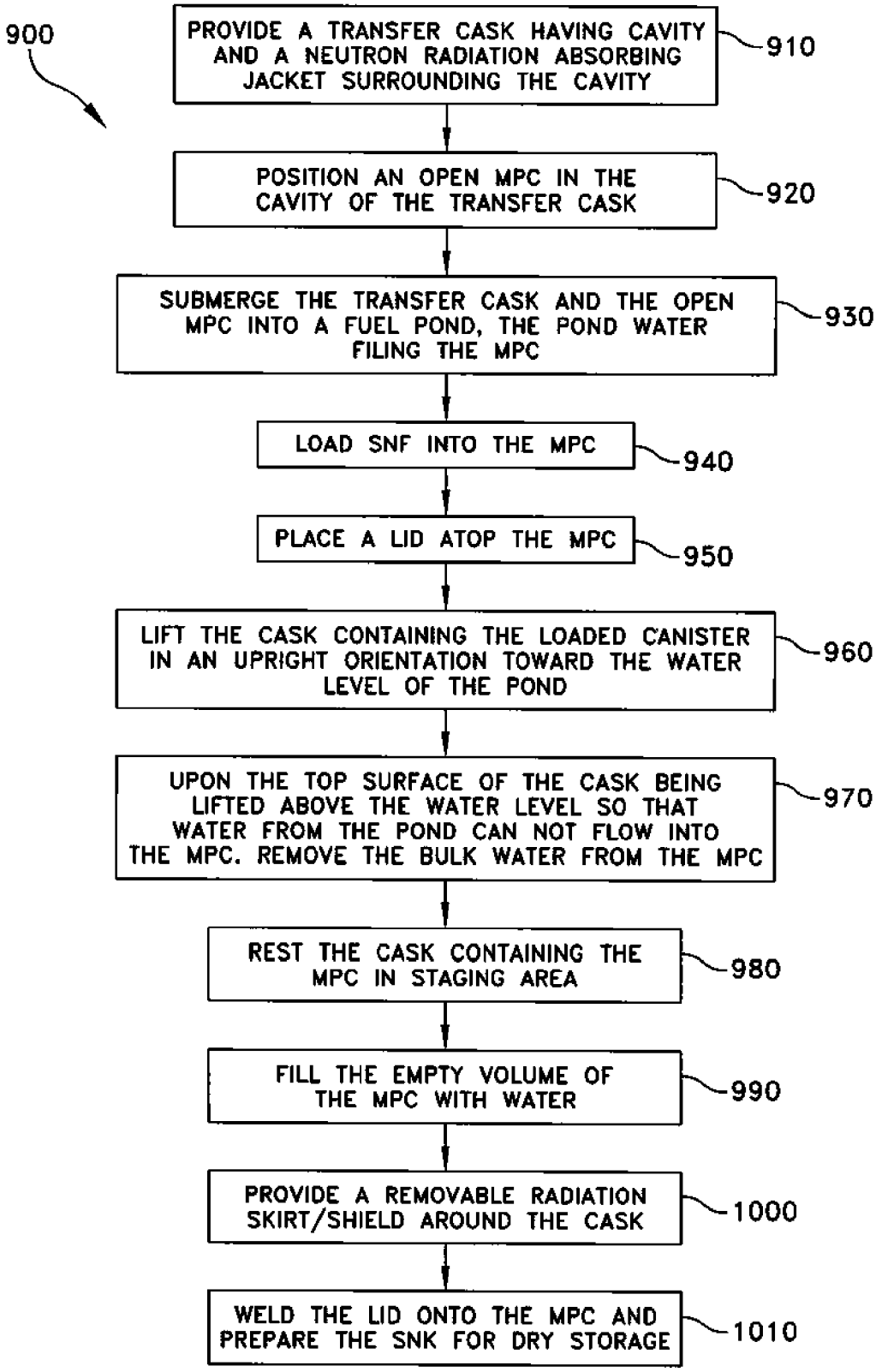
FIG. 9 is a flowchart of an embodiment of a method of removing a transfer cask from a fuel pool according to one embodiment of the present invention.

Referring now to FIG. 9, a method of the present invention is illustrated in the form of a flowchart 900. The steps of FIG. 9 will be discussed in relation to the apparatus shown in FIGS. 1-8.

In defueling a nuclear reactor and storing the spent nuclear fuel, a transfer cask 100 having cavity 6 and a neutron radiation absorbing jacket 20 surrounding the cavity 6 is provided. Thereby accomplishing step 910. An open multi purpose canister (MPC) is placed in cavity 6 of transfer cask 100, completing step 920. When the embodiment is utilizing a canister and cask, i.e., a dual containment system, the entire structure is thought of as a container having a top, a bottom, and a cavity. The transfer cask 100 with the open MPC is submerged into a fuel pond so that the top of the MPC is below a surface level of the fuel pond. The water from the fuel pond fills the open MPC, thereby completing step 930.

When the nuclear fuel is depleted in the nuclear reactor, the spent nuclear fuel is removed from the reactor, lowered into the fuel pond, and placed into the MPC, thereby completing step 940. Once the MPC is fully loaded, a lid is secured to the MPC enclosing the both the spent nuclear fuel and water from the storage pond, completing step 950.

A crane or other lifting device is attached to trunnions 61 of transfer cask 100. Once secured to trunnions 61, the crane lifts transfer cask 100, containing the loaded MPC, in an upright orientation toward the water level of the storage pond, completing step 960. The top surface of transfer cask 100 is lifted to be just above the water level so that water from the storage pond can no longer flow into the MPC. Preferably, the top surface of the transfer cask 100 is between 1 to 12 inches above the surface level of the body of water so that a substantial portion of the transfer cask 100 and MPC remains below the surface level of the water in the fuel pond. Additionally, it is to be understood that rather than raising the transfer cask 100 above the surface level of the fuel pond, the water in the fuel pond could be drained until the top of the MPC is above the lowered surface level of the fuel pond. Stated broadly, step 960 can be achieved by relative movement of the transfer cask 100 and the water in the fuel pond. Upon the transfer cask 100 being just above the water level, bulk water is removed from the MPC, thereby completing step 970. The weight within transfer cask 100 has now been reduced in an amount equal to the weight of bulk water removed. At this stage, the lifting device removes transfer cask 100 containing the MPC from the storage pond and places it onto a staging area, completing step 980. While in the staging area, the empty volume of the MPC is filled with water, completing step 990.

A removable radiation shield/skirt 200 is then slidably placed around the transfer cask 100. The shield 200 is positioned above the transfer cask 100 by using a crane connected to the eye hooks 212. The shield 200 is lowered so that the open bottom end 225 of the shield 200 slides over the transfer cask 100. The horizontal portion 231 of the spacer 230 contacts an upper surface of the top ring plate 56 and rests thereupon. Cool air then enters into the chamber 240 and rises within the chamber 240 until exiting at the top. This cool air acts to remove heat emitted by the spent nuclear fuel stored in transfer cask 100. Step 1000 is now complete. The lid is now welded onto the MPC and the spent nuclear fuel is prepared for long term dry-state storage. The water is drained from the MPC and the MPC is filled with an inert gas. Such filling with gas is well known in the art. Thus, step 1010 is completed.

The method of the invention can comprise any combination of the steps mentioned above. All of the steps are not necessary to practice the invention.

What is claimed is:

1. An apparatus for providing additional radiation shielding to a container holding radioactive materials comprising:

a tubular shell extending from a first end to a second end, the tubular shell constructed of a gamma radiation absorbing material and having an inner surface that forms a cavity;

a first opening in the first end of the tubular shell that provides a passageway into the cavity;

a second opening in the second end of the tubular shell that provides a passageway into the cavity, the second opening being larger than the first opening;

a plurality of spacers extending from the inner surface of the shell;

a ring-like member connected to the first end of the tubular shell, the ring-like member comprising the first opening and having a bottom surface; and wherein the spacers are a plurality of L-shaped plate structures extending from the inner surface of the shell and the bottom surface of the ring-like member.

2. The apparatus of claim 1 wherein the spacers are circumferentially spaced from one another about an axis of the cavity.

3. The apparatus of claim 1 further comprising:

the cavity having an axis; and the L-shaped plate structures being substantially parallel to the axis of the cavity and arranged in a spaced relation to one another so as to form channels therebetween.

4. The apparatus of claim 1 further comprising means on the first end of the tubular shell for lifting the apparatus.

5. The apparatus of claim 1 further comprising one or more channels that extend from along the inner surface of the tubular shell from the first end of the tubular shell to the second end of the tubular shell.

6. An apparatus for providing additional radiation shielding to a container holding radioactive materials comprising:

a tubular shell constructed of a gamma radiation absorbing material and having an inner surface that forms a cavity having an axis, the cavity having an open top end and an open bottom end;

a plurality of spacers extending from the inner surface of the shell toward the axis of the cavity, the spacers extending a first height from the inner surface of the tubular shell;

one or more flange members located at or near the open top end of the cavity extending from the tubular shell toward the axis of the cavity, the flange member extending a second height from the inner surface of the shell, the second height being greater than the first height; and wherein the flange members and spacers are formed by upside-down L-shaped plates connected to the inner surface of the tubular shell in a circumferentially spaced arrangement about the axis.

7. The system of claim 6 further comprising one or more channels extending from the open bottom end of the cavity to the open top end of the cavity.

8. The system of claim 6 further comprising a ring-like member connected to a top of the tubular shell.

9. A system for handling and/or processing radioactive materials comprising:

a container having a first cavity for holding radioactive materials, the container having an outer surface and a top surface;

a tubular shell having an inner surface that forms a second cavity for receiving the container, the tubular shell comprising at least one spacer extending a first height from the inner surface of the shell toward an axis of the second cavity;

the container positioned in the second cavity of the tubular shell, the at least one spacer maintaining the inside surface of the tubular shell in a spaced relationship from the outer surface of the container;

wherein the tubular structure is non-unitary and slidably removable from the container; and wherein the tubular shell further comprises one or more flange members extending from the tubular shell toward the axis of the second cavity, the one or more flange members extending a second height from the inner surface of the shell, the second height being greater than the first height; and wherein the one or more flange members rest atop the top surface of the container and the at least one spacer rests against the outer surface of the container.

10. The system of claim 9 wherein the second cavity of the tubular shell has an open top end defined by a first opening and an open bottom end defined by a second opening.

11. The system of claim 10 wherein the second opening is sized and shaped to allow a body portion of the container to slidably pass therethrough in an unobstructed manner.

12. The system of claim 11 wherein the container further comprises a lid positioned atop the body portion of the container that substantially encloses a top end of the first cavity; and wherein the first opening is sized and shaped to allow the lid to slidably pass therethrough in an unobstructed manner.

13. The system of claim 9 wherein the at least one spacer maintains the inside surface of the tubular shell in the spaced relationship from the outer surface of the container so as to form an annular gap between the tubular shell and the container.

14. The system of claim 13 wherein the annular gap comprises one or more channels that extend from an inlet at or near a bottom of the tubular shell to an outlet at or near a top of the tubular shell.

15. The system of claim 9 wherein the container comprises both gamma radiation absorbing material and neutron absorbing material and the tubular shell is constructed of a gamma radiation absorbing material.

16. A system for handling and/or processing radioactive materials comprising:

a container having a first cavity for holding radioactive materials, the container having an outer surface and a top surface;

a tubular shell having an inner surface that forms a second cavity for receiving the container, the tubular shell comprising at least one spacer extending from the inner surface of the shell toward an axis of the second cavity;

the container positioned in the second cavity of the tubular shell, the at least one spacer maintaining the inside surface of the tubular shell in a spaced relationship from the outer surface of the container;

wherein the tubular structure is non-unitary and slidably removable from the container; and wherein the second cavity of the tubular shell has an open top end defined by a first opening and an open bottom end defined by a second opening; and wherein a top of the container protrudes from the first opening.

17. A system for handling and/or processing radioactive materials comprising:

a container having a first cavity for holding radioactive materials, the container having an outer surface and a top surface;

a tubular shell having an inner surface that forms a second cavity for receiving the container, the tubular shell comprising at least one spacer extending from the inner surface of the shell toward an axis of the second cavity;

the container positioned in the second cavity of the tubular shell, the at least one spacer maintaining the inside surface of the tubular shell in a spaced relationship from the outer surface of the container;

wherein the tubular structure is non-unitary and slidably removable from the container; and wherein the container has a height that is greater than a height of the tubular shell.

18. A method of handling and/or processing radioactive materials comprising:

a) placing a container having a first cavity containing radioactive materials in a staging area, the container having an outer surface and a top surface;

b) providing a tubular shell having an inner surface that forms a second cavity for receiving the container, the second cavity having an open top end and an open bottom end, the tubular shell also comprising at least one spacer extending from the inner surface of the shell toward an axis of the second cavity; and c) positioning the tubular sleeve above the container and lowering the tubular shell so that the container slidably inserts through the open bottom end and into the second cavity, the at least one spacer maintaining the inside surface of the tubular shell in a spaced relationship from the outer surface of the container so as to form a gap between the container and the tubular shell;

wherein the at least one spacer extends a first height from the inner surface of the tubular shell toward the axis of the second cavity;

wherein the tubular shell further comprises one or more flange member extending from the tubular shell toward the toward the axis of the second cavity, the one or more flange members extending a second height from the inner surface of the shell, the second height being greater than the first height; and wherein step c) comprises lowering the tubular shell until the one or more flange members contact and rest atop the top surface of the container, the tubular shell being supported by the one or more flange members.

19. The method of claim 18 further comprising:

d) cool air entering the gap at or near a bottom of the tubular shell, the cool air becoming warmed from heat emanating from the container, the warmed air rising within the gap and exiting the gap at or near a top of the tubular shell.

20. A method of handling and/or processing radioactive materials comprising:

a) placing a container having a first cavity containing radioactive materials in a staging area, the container having an outer surface and a top surface;

b) providing a tubular shell having an inner surface that forms a second cavity for receiving the container, the second cavity having an open top end and an open bottom end, the tubular shell also comprising at least one spacer extending from the inner surface of the shell toward an axis of the second cavity; and c) positioning the tubular sleeve above the container and lowering the tubular shell so that the container slidably inserts through the open bottom end and into the second cavity, the at least one spacer maintaining the inside surface of the tubular shell in a spaced relationship from the outer surface of the container so as to form a gap between the container and the tubular shell;

wherein step c) comprises sliding the tubular shell over the container until a top portion of the container protrudes from a top end of the tubular shell;

d) securing a lid to the top portion of the container; and e) lifting the tubular shell until the container slidably exits the second cavity.

* * * * *